US006987710B2

(12) United States Patent
Kibiloski et al.

(10) Patent No.: US 6,987,710 B2
(45) Date of Patent: Jan. 17, 2006

(54) ALARM CLOCK WITH DIAL ILLUMINATION

(75) Inventors: Keith E. Kibiloski, Virginia Beach, VA (US); Charles Wong Tak Chung, Quarry Bay (HK)

(73) Assignee: Equity Industries, Inc., Virginia Beach, VA (US)

( * ) Notice: Subject to any disclaimer, the term of this patent is extended or adjusted under 35 U.S.C. 154(b) by 188 days.

(21) Appl. No.: 10/459,786

(22) Filed: Jun. 12, 2003

(65) Prior Publication Data

US 2003/0206495 A1 Nov. 6, 2003

Related U.S. Application Data

(63) Continuation-in-part of application No. 10/304,329, filed on Nov. 26, 2002.

(60) Provisional application No. 60/387,989, filed on Jun. 12, 2002, provisional application No. 60/334,428, filed on Nov. 30, 2001.

(51) Int. Cl.
*G04B 19/30* (2006.01)
*G04C 21/00* (2006.01)
*G04C 21/16* (2006.01)

(52) U.S. Cl. ..... 368/67; 368/73; 368/227; 368/256

(58) Field of Classification Search ..... 368/84, 368/67, 227, 66, 204, 73, 88, 250
See application file for complete search history.

(56) References Cited

U.S. PATENT DOCUMENTS 3,591,825 A * 7/1971 Keighley, Jr. ..... 315/82
4,044,546 A 8/1977 Koike ..... 58/50
4,171,769 A 10/1979 Trimpey ..... 206/46
4,451,157 A 5/1984 Reap ..... 368/11
4,647,217 A 3/1987 Havel ..... 368/10
4,702,615 A 10/1987 Havel ..... 368/82
4,705,406 A 11/1987 Havel ..... 368/10
4,785,432 A 11/1988 Havel ..... 368/82
5,088,056 A * 2/1992 McIntosh et al. ..... 702/177
D326,726 S 6/1992 Swain, Jr. ..... D26/54
5,128,782 A * 7/1992 Wood ..... 349/61
5,143,433 A * 9/1992 Farrell ..... 362/29

(Continued)

OTHER PUBLICATIONS

Equity, Electric Quartz Operating Instructions Model 33101, Livermore, CA 94550 U.S.A.

*Primary Examiner*—Vit W. Miska
(74) *Attorney, Agent, or Firm*—Cook, Alex, McFarron, Manzo, Cummings & Mehler, Ltd.

(57) ABSTRACT

An alarm clock of the analog type with hands for indicating the time includes a battery, a housing, a dial with time indicia disposed in the housing and an illumination module disposed adjacently to the dial. The illumination module has one or more recesses defined in an edge with one or more light sources disposed in the recesses to provide illumination into the module. The illumination module has edges and a back surface with light reflective properties to reflect light in the interior of the module and out the front surface and through the dial to provide night lighting exterior to the clock. Preferably, the module has an ovate shape such that the recesses and light sources are disposed outside of the dial area. A light sensor senses the ambient lighting conditions and activates and deactivates the light source. A dimmer control adjusts the desired level of illumination. A three position switch controls the alarm clock between alarm only, night light only, and both alarm and night light modes of operation.

13 Claims, 5 Drawing Sheets

U.S. PATENT DOCUMENTS

| | | | | | |
|---|---|---|---|---|---|
| 5,309,145 | A | | 5/1994 | Branch et al. | 340/540 |
| 5,359,577 | A | * | 10/1994 | Hoshino et al. | 368/67 |
| 5,381,388 | A | | 1/1995 | Beiswenger et al. | 368/69 |
| 5,465,198 | A | | 11/1995 | Kellogg | 362/253 |
| 5,487,053 | A | | 1/1996 | Beiswenger et al. | 368/69 |
| 5,524,101 | A | * | 6/1996 | Thorgersen et al. | 368/10 |
| 5,610,741 | A | | 3/1997 | Kimura | 349/113 |
| 5,714,247 | A | | 2/1998 | Kuo et al. | 428/323 |
| 5,926,440 | A | * | 7/1999 | Chien | 368/10 |
| 5,936,688 | A | | 8/1999 | Tsuda et al. | 349/113 |
| D423,698 | S | | 4/2000 | Yuen | D26/26 |
| 6,158,868 | A | | 12/2000 | Chien | 362/84 |
| 6,166,793 | A | | 12/2000 | Hayashi et al. | 349/113 |
| 6,280,053 | B1 | | 8/2001 | Chien | 368/228 |
| 6,292,439 | B1 | | 9/2001 | Akiba et al. | 368/84 |
| 6,334,689 | B1 | * | 1/2002 | Taniguchi et al. | 362/31 |
| 2001/0033481 | A1 | | 10/2001 | Chien | 362/34 |
| 2003/0174586 | A1 | * | 9/2003 | Hon et al. | 368/84 |

* cited by examiner

FIG. 4
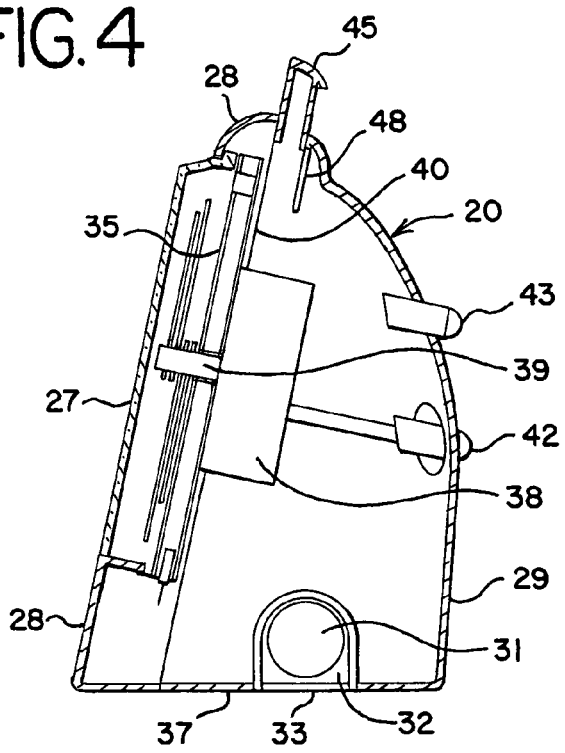
FIG. 5
| 2-POSITION SWITCH | INDICATES |
|---|---|
| 46 | ALARM OFF |
| 47 ALARM ON | ALARM ON |
FIG. 6
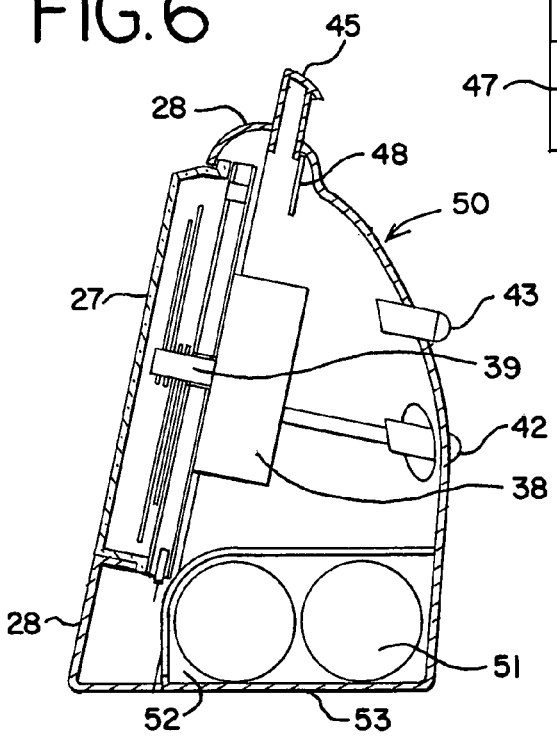

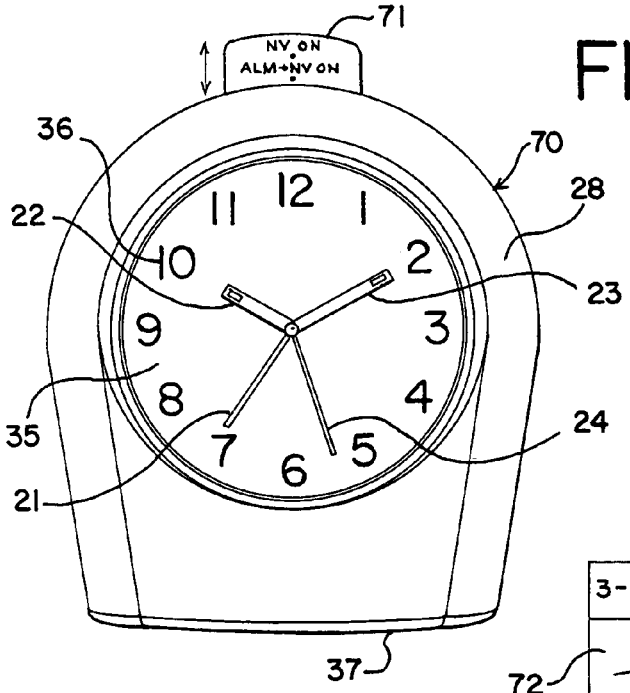
FIG. 11
FIG. 12
| 3-POSITION SWITCH | INDICATES |
|---|---|
| 72 | ALARM OFF |
| 73 NV ON | NIGHT VISION ON |
| 74 NV ON ALM+NV ON | BOTH ALARM & NIGHT VISION ON |
FIG. 13
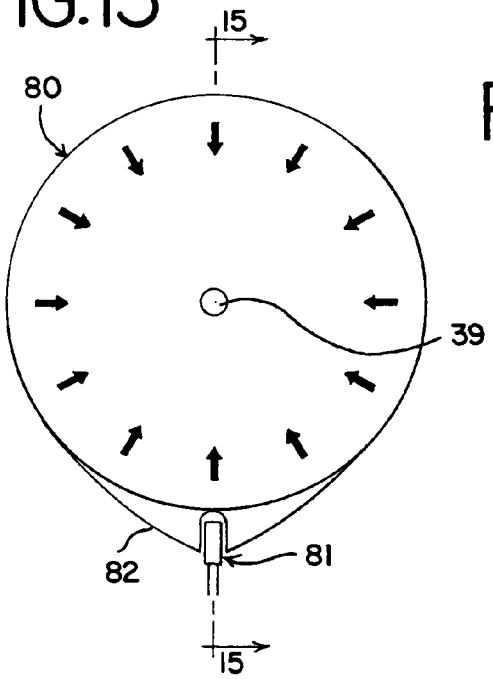
FIG. 14
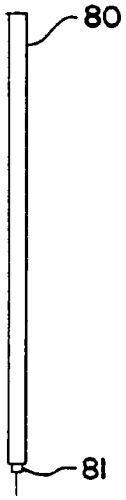
FIG. 15
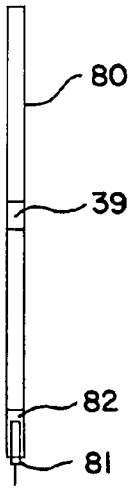

ALARM CLOCK WITH DIAL ILLUMINATION

CROSS-REFERENCE TO RELATED APPLICATION

This patent application is a non-provisional application of prior U.S. provisional patent application Ser. No. 60/387,989, filed on Jun. 12, 2002, and is a continuation-in-part application of U.S. patent applications "Clocks Having Diffusion Reflector Lighting", Ser. No. 10/304,329, filed on Nov. 26, 2002 and Ser. No. 60/334,428, filed on Nov. 30, 2001, the rights of priority of which are hereby claimed for this patent application.

BACKGROUND OF THE INVENTION

This invention generally relates to clocks having multiple features including unique lighting and time display features. More particularly, a preferred embodiment of the invention relates to illumination of the dial of the clock, which may be associated with a night light feature that may be activated and deactivated automatically in response to ambient lighting conditions, or that may be activated and deactivated manually by a user-operated switch.

Various types of alarm clocks are known to the prior art, including analog alarm clocks with hands to indicate the current time and digital clocks with digits to display the current time. Some analog alarm clocks also include certain illumination features to assist in reading the time under the low level lighting conditions usually encountered during the evening hours. However, such analog alarm clocks with illumination do not provide sufficient illumination to also provide night lighting for the room in which the clock is located.

Particularly in a battery-powered alarm clock, the illumination of the clock needs to be efficient since the amount of the current drain on the batteries is inversely related to the life of the batteries.

There is therefore a need for an analog alarm clock with an illumination system that efficiently converts light from a light source into illumination for the dial of the alarm clock for easy viewing of the displayed time, and that also provides dispersed lighting into a room to serve as a night light.

Also needed is an analog alarm clock that automatically activates the illumination features when the ambient lighting falls below a predetermined threshold and that automatically deactivates the illumination features when the ambient lighting rises above a predetermined threshold.

An analog alarm clock with illumination features that may be varied by the user to his/her preferences is also desirable.

It is therefore a general object of the present invention to provide an improved alarm clock with an illumination module to efficiently provide illumination of the face of the clock and to provide sufficient light dispersion out of the illumination module for night lighting of the room in which the clock is located.

A further object of the present invention is to automatically activate the illumination features when the ambient lighting falls below a predetermined threshold, and to automatically deactivate the illumination when the ambient lighting rises above a predetermined threshold.

Yet another object of the present invention is to provide the capability for the user to manually control the illumination features of the alarm clock to his/her desired illumination characteristics.

Another object of the present invention is to provide an improved alarm clock with an LED light source that is positioned in an edge of the illumination module.

SUMMARY OF THE INVENTION

The present invention is directed to various illumination features for an alarm clock of the analog type with hands to display the time. The illumination may be automatically activated in response to low ambient lighting conditions, such as encountered during the evening hours, and may be automatically deactivated when normal ambient lighting conditions return in the morning hours. A light sensor is used to detect the ambient lighting levels. The illumination may alternatively be manually controlled by a user-operated switch. A dimmer control adjusts the amount of illumination provided by the illumination module.

A light illumination module, such as a light emitting diode (LED), in combination with a light reflector, is disposed either in front of, or behind, the clock dial to provide uniform lighting of the dial of the clock and to also provide sufficient light dispersion out of the light module for night lighting of the room in which the alarm clock is located. The light illumination module is preferably of ovate shape, with an enlarged end that has one or more recesses defined therein to receive one or more light sources, such as LEDs. This enlarged end of the illumination module, with the recesses and light sources, typically extends beyond the normal viewing area of the dial of the clock, and is hidden from view by the frame or housing of the clock.

For best light transmission and dispersion from the light sources to illuminate the dial of the clock and to provide night lighting in the room, the illumination module is preferably transparent, such as of clear acrylic plastic, with the edges of the module having reflective properties, such as provided by reflective coatings or paint. However, the edges of the recesses, in which the light sources are disposed, are clear for receiving illumination from the light sources into the illumination module.

The illumination module is typically positioned behind the dial. The dial is clear or translucent except for the time or other indicia on the dial and the back surface of the illumination module may be coated with a generally opaque reflective coating, or have a reflective material disposed behind the illumination module, such as plastic sheet material, foils, or the like. Such sheet material or foils may be embossed, engraved, imprinted by silk screen techniques, or the like, to enhance light dispersion in and out of the illumination module. If the illumination module is disposed in front of the dial, the back surface of the illumination module will be clear to see the indicia on the dial, and the dial will be generally opaque and reflective to reflect and disperse illumination about the dial and out of the illumination module to provide night lighting.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures in which like reference numerals identify like elements, and in which:

FIG. 4 is a cross-sectional view of the alarm clock illustrated in FIGS. 1–3 taken along the sectional line 4—4 of FIG. 2.

FIG. 5 is a pictorial diagram of an alarm switch for the alarm clocks in FIGS. 1–4 and 6 illustrating the different positions thereof.

FIG. 6 is a cross-sectional view, similar to the cross-sectional view of FIG. 4, but for a battery powered alarm clock, with ambient light sensing for automatic activation and deactivation of the lighting functions.

FIG. 11 is a front elevational view of an alarm clock with manually controlled activation and deactivation of the illumination functions in accordance with the invention.

FIG. 12 is a pictorial diagram of an alarm switch for the alarm clock in FIG. 11 illustrating the various positions thereof.

FIG. 13 is a front elevational view of an illumination module for use in the alarm clock illustrated in FIG. 11.

FIG. 14 is a side elevational view of the illumination module illustrated in FIG. 13.

FIG. 15 is a cross-sectional view of the illumination module of FIGS. 13 and 14 taken along the sectional line 15—15 of FIG. 13.

DETAILED DESCRIPTION OF THE INVENTION

Figure 1:
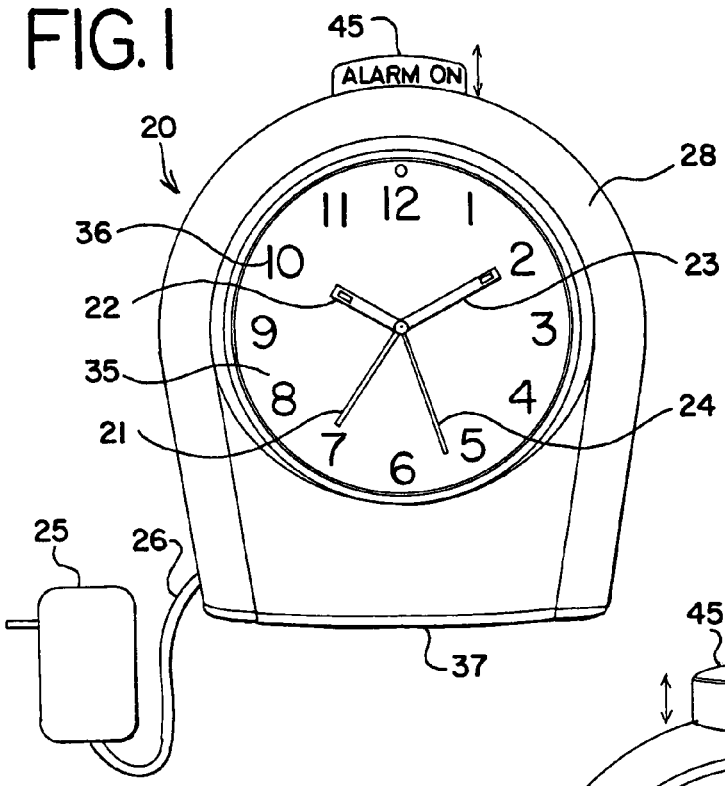
FIG. 1 is a front elevational view of an AC powered alarm clock with ambient light sensing for automatic activation and deactivation of the lighting functions in accordance with the invention.

Referring to the Figures, and particularly to FIG. 1, a clock, generally designated 20, is constructed in accordance with the invention. Clock 20 is of the analog type with hands, such as an hour hand 22, a minute hand 23 and a second hand 24, for indicating the time. Clock 20 also has an alarm time hand 21 for indicating the time of the alarm setting.

Clock 20 may be powered from a common AC outlet. An AC plug 25 is suitable for insertion in an AC outlet, and a line cord 26 electrically connects the clock 20 with the plug 25. As seen in FIG. 4, the clock 20 may also be provided with a back-up battery 31 contained within a battery compartment 32 that is accessible by a battery door 33. Back-up battery 31 supplies operating power to clock 20 during temporary AC power outages, and may be of the alkaline type, such as the commonly available AA size.

Figure 2:
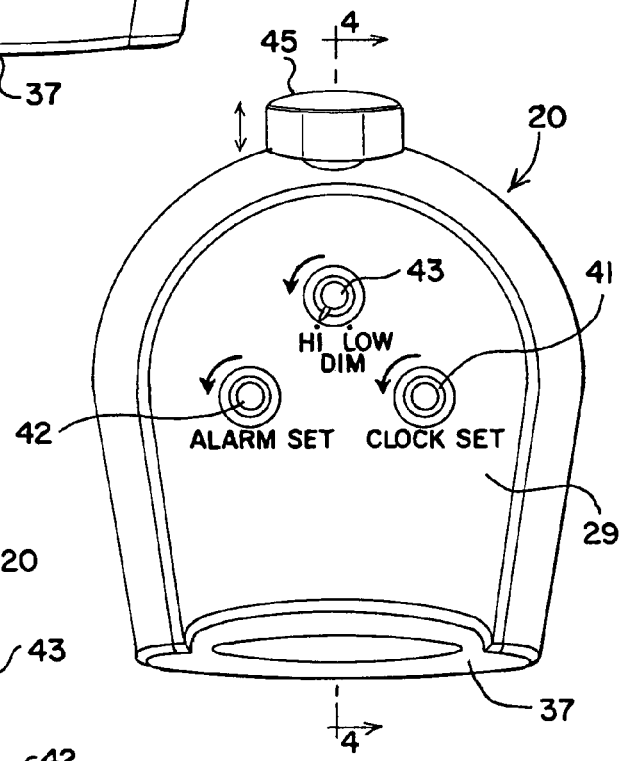
FIG. 2 is a rear elevational view and partial bottom plan view of the alarm clock illustrated in FIG. 1.
Figure 3:
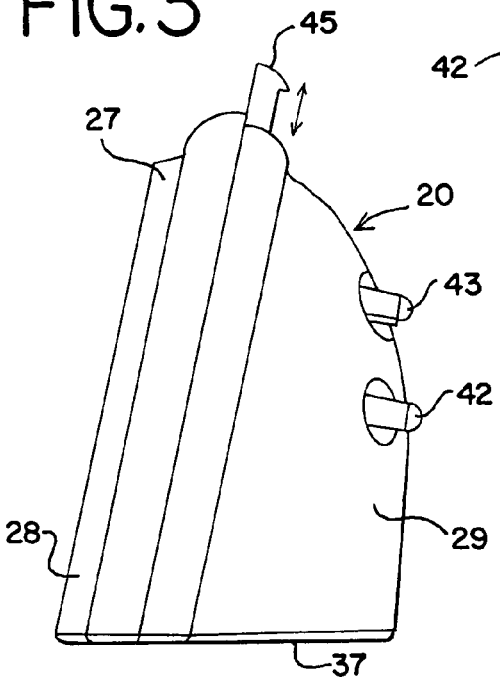
FIG. 3 is a side elevational view of the alarm clock illustrated in FIGS. 1 and 2.

Clock 20 has a housing including a front housing portion 28 and a rear housing portion 29 (FIGS. 1–3). In addition to the shapes depicted in the drawing figures, housing portions 28 and 29 can be supplied with other ornamental features or be configured into other ornamental shapes, as desired. Wood and/or metal accents could also be utilized. Housing portions 28 and 29 can also be fabricated from different materials. For example, to satisfy the tastes of consumers, housing portions 28 and 29 could be different colors of plastic. As one example, the housing portions 28 and 29 may be formed from a thermoplastic, as by injection molding. The front and rear housing portions 28 and 29 may snap fit together by means of techniques well-known in the plastic molding arts.

As seen in FIG. 4, a generally transparent lens 27 may engage the front housing portion 28 to enclose and to protect the time indicating hands 21–24 from damage, and to keep dust and contaminants from accumulating in the interior of clock 20. Lens 27 may be formed, for example, from a transparent plastic material. Most of the visible portion of lens 27 may be generally flat as shown in FIGS. 3 and 4, or any other suitable or ornamental shape.

Clock 20 has a face or dial 35 which has disposed thereon a plurality of time-indicating numerals, such as the numeral "10" at 36. The "NIGHT VISION" mark and logo shown on the dial 35 are trademarks of Equity Industries Corp.

With reference to FIGS. 1–4, clock 20 has a generally flat base 37 suitable for standing clock 20 on a desk, night stand, dresser, table, or the like.

As seen in FIG. 4, clock 20 has a movement 38 adapted to move the time indicating hands 22–24. Movement 38 is preferably of the quartz type for excellent time accuracy. Shafts of the movement 38 extend through apertures, such as an aperture 39 in a reflector 40.

A plurality of knobs is provided on the back side of the clock 20, as seen in FIG. 2, to enable the user to set the clock 20. A clock set knob 41 can be rotated, as indicated in FIG. 2, to initially set the time for clock 20 by moving the hour and minute hands, 22 and 23, respectively. An alarm set knob 43 can be rotated to move alarm time hand 24 to the desired alarm time. A dimmer knob 43 can be rotated to set the dial illumination to any desired level between low and high positions.

An alarm activation switch 45 is disposed near the top of the clock 20. Alarm switch 45 slides between two positions as illustrated in FIG. 5. In the down or retracted position, the alarm function for clock 20 is turned off, as illustrated in depiction 46 of FIG. 5. In the up or raised position, as illustrated in depiction 47 of FIG. 5, the alarm function is activated. When sliding up or down, switch 45 engages electrical contacts located on an adjacent printed circuit board 48 (FIG. 4).

An alarm clock 50 is illustrated in FIG. 6. Clock 50 is another embodiment of clock 20. Clock 50 operates from a pair of batteries 51 within a battery compartment 52 that is accessible through a battery door 53. For example, batteries 51 may be of the alkaline type in the commonly available C size. Some consumers, such as travelers, prefer a battery-operated clock since it does not need resetting when removed from luggage, or the like. Otherwise, clock 50 is similar to clock 20.

There are, of course, other alternatives to alkaline batteries. Rechargeable batteries could be used in place of the alkaline batteries. The front of clock 50 could also incorporate one or more solar cells to provide operating current for the clock during the daylight hours, with the batteries 51 acting as back-up power during the evening hours. Such solar cells could also use any excess power capacity to recharge the rechargeable batteries during the day.

Figure 7:
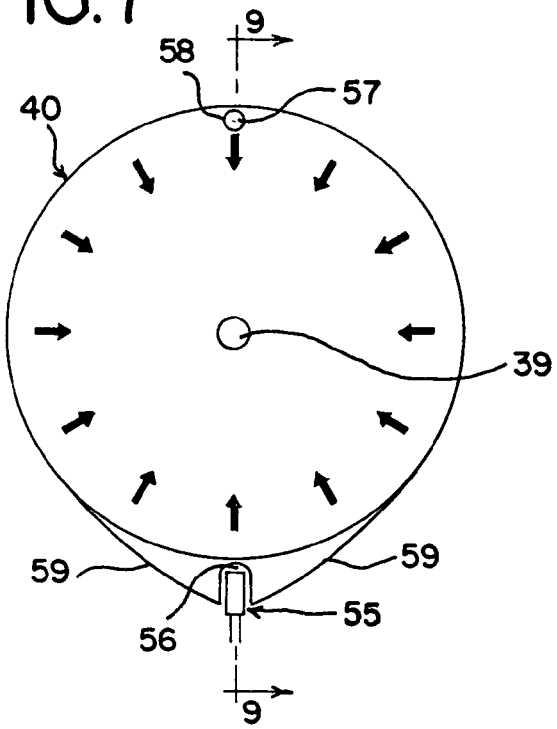
FIG. 7 is a front elevational view of an illumination module with a single light source for use in the alarm clocks illustrated in FIGS. 1–4 and 6.

In accordance with one aspect of the present invention, an illumination module illustrated in FIG. 7, consisting of a light emitting diode (LED) 55 in combination with a light reflector 40, provides lighting for the dial 35 of the clock 20 or 50 under dim lighting conditions typically found in homes or offices after sunset. LED 55 and reflector 40 also provide sufficient light dispersion to function as a night light in unlit or dimly lit rooms.

Disposed near the top edge of reflector 40 is a light sensor 57, such as a photoelectric cell, as shown in FIG. 7. Light sensor 57 continually senses the light level of the room in which clock 20 or 50 is located. When the ambient light level falls below a predetermined threshold, light sensor 57 causes LED 55 to be electrically energized by a power source to activate illumination from LED 55 for clock 20 or 50. Similarly, if the ambient light level rises above a predetermined threshold, light sensor 57 causes LED 55 to be electrically disconnected from the power source to deactivate any illumination. The light sensor 57 can be disposed in the aperture 58 defined near the top edge of reflector 40.

Dial 35 is in front of, and generally overlies the reflector 40. For good light transmission therethrough, dial 35 is generally transparent, except for the generally opaque time-indicating numerals 36 and other indicia, as the trademark Night Vision.

Figure 8:
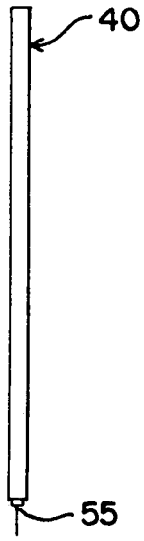
FIG. 8 is a side elevational view of the illumination module illustrated in FIG. 7.
Figure 9:
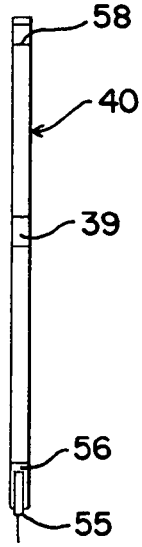
FIG. 9 is a cross-sectional view of the illumination module of FIGS. 7 and 8 taken along the sectional line 9—9 of FIG. 7.

The light illumination module including LED 55 and reflector 40 is better seen in FIGS. 7–9. With reference to FIG. 7 first, when the dial 35 is of generally circular configuration, as in the embodiment illustrated in FIGS. 1–4, the reflector 40 is preferably of generally ovate shape. That is, a portion of reflector 40 extends below the circular dial 35 for enclosing LED 55 in a recess 56 formed in the reflector 40. In this example, recess 56 is of generally U-shape in the bottom edge of reflector 40, and LED 55 is disposed in the U-shaped recess 56. Recess 56 and LED 55 are out of view when observing the face of the clock.

The optical properties of reflector 40 contribute significantly to the efficiency of the light module to illuminate the dial 35 and to provide sufficient illumination from clock 20 or 50 for night light capability. Reflector 40 is ideally transparent and may be formed from a clear acrylic plastic material. As seen in FIG. 8, the edge periphery of the reflector 40 is coated with an optically reflective and opaque coating such that light from LED 55 is reflected back into the interior of the reflector from all angles. This optically reflective coating may be, for example, a white paint. The front side of reflector 40 that abuts the dial 35 in FIG. 4 is uncoated and transparent for light transmission therethrough. However, portions of the front side of reflector 40 that are not visible from the front of the clock, such as those portions designated 59 on either side of LED 55 are also optically coated for maximum light reflectivity from LED 55 into the central area of reflector 40.

The back side of reflector 40 is also preferably coated to provide a light reflective surface. Light dispersion from the reflector 40 through the dial 35 and into the room in which the clock 20 or 50 is located is also desired to provide a night light function.

LED 55 is preferably disposed within a recess or notch, such as in the U-shaped recess 56 defined in the periphery of reflector 40, such that virtually all of the light emitted by LED 55 is gathered and transmitted by the reflector 40.

Figure 10:
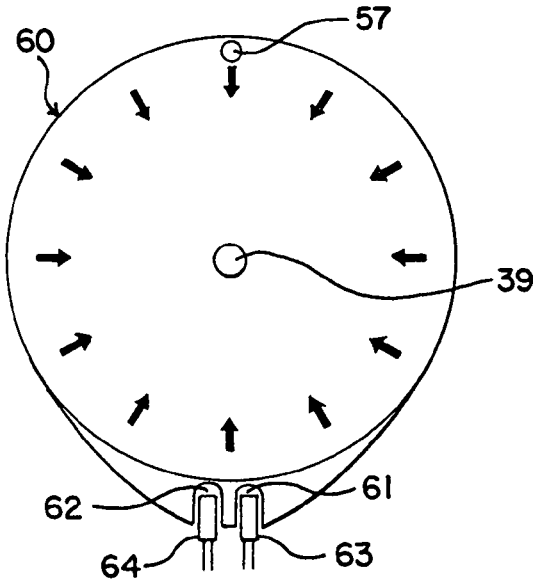
FIG. 10 is a front elevational view of an illumination module with two light sources for use in the alarm clocks illustrated in FIGS. 1–4 and 6.

Clock 20 or 50 may, of course, be provided with more than one LED. Shown in FIG. 10 is a reflector 60 with two U-shaped recesses 61 and 62 suitable for provision of two LEDs 63 and 64, with one LED in each recess. LEDs 61 and 62 preferably provide different color light for enhanced lighting effects in clock 20 or 50. LEDs 61 and 62 may also indicate different clock conditions. For example, LED 61 may be of a yellow color to indicate normal functioning of clock 20 or 50, and LED 62 may be of a red color to indicate low battery capacity, to indicate that batteries 51 should be replaced.

It will be apparent that many alternatives exist to the described structure for clock 20 or 50. For example, instead of a separate dial 35 with the time indicia 36 disposed in front of the reflector 40 or 60, these two elements could be combined by printing the time indicia 36 on the back side of reflector 40 or 60 prior to coating the back side of reflector 40 or 60 with the reflective coating. Yet another example is that one enlarged recess could be provided for each LED 63 and 64 in the reflector design of FIG. 10 instead of the two recesses 61 and 62 for separately containing the two LEDs 63 and 64.

Shown in FIG. 11 is a third embodiment of a clock, generally designated 70, constructed in accordance with the invention. In many respects, clock 70 is similar in structure to clocks 20 and 50. However, it will be noticed that clock 70 does not have a light sensor, such as light sensor 57 for clocks 20 and 50, disposed near the top of the dial 35. The dial illumination for clock 70 is manually activated and deactivated by a user-operated switch 71. As shown in the depictions of FIG. 12, switch 71 is movable between three positions. When switch 71 is fully down, as in depiction 72 of FIG. 12, both the alarm and illumination functions are off. In the intermediate position illustrated in depiction 73, the illumination function is on, but the alarm function is off. In the uppermost position of switch 71 illustrated in depiction 74, both the alarm and illumination functions are on.

Clock 70 may be primarily AC powered with battery back-up, as clock 20, or entirely battery powered, as clock 50. Of course, manual control of the illumination function, as by switch 71 in clock 70, can extend battery life by terminating the illumination function when not needed. As with clocks 20 and 50, dimmer knob 43 may be used to vary the level of illumination to any desired level between maximum and minimum levels.

Illustrated in FIG. 13 is a reflector 80 for the clock 70 which utilizes one LED 81 disposed in a U-shaped recess 82. Note, however, that reflector 80 does not have an aperture 58 for a light sensor 57. Thus, LED 81 may alternatively be disposed along a top edge of reflector 80 since there is no aperture 58 or light sensor 57 adjacently disposed to the LED 81 that could interfere with some paths of light transmission from the LED 81.

The structure and operation of the reflector 80, as shown in FIGS. 14 and 15, is similar to the structure and operation of the reflector 40 shown in FIGS. 8 and 9, except for the absence of the light sensor 57 disposed in the aperture 58 of reflector 40.

Figure 16:
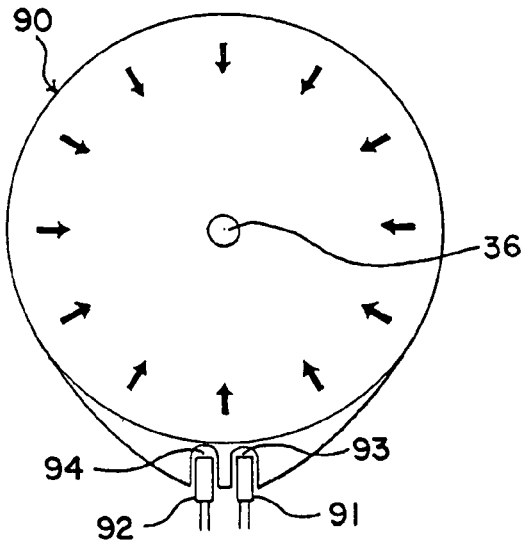
FIG. 16 is a front elevational view of an illumination module with two light sources for use in the alarm clock illustrated in FIG. 11.

Illustrated in FIG. 16 is an alternative illumination module, including two LEDs 91 and 92 each disposed in a respective U-shaped recess 93 and 94. Other than the absence of the light sensor 57, reflector 90 and its associated LEDs 91 and 92 will operate similarly to the prior description of the dual-LED reflector 60 in FIG. 10 for clocks 20 and 50.

Other variations may be made to the design of the various reflectors 40, 60, 80 and 90 shown in FIGS. 7, 10, 13 and 16, respectively. For example, instead of the previously described reflective coating on the back sides of these reflectors, a reflective surface could be disposed along the back side of these reflectors 40, 60, 80 or 90, such as metal foil, colored plastic sheet materials, or the like.

Figure 17:
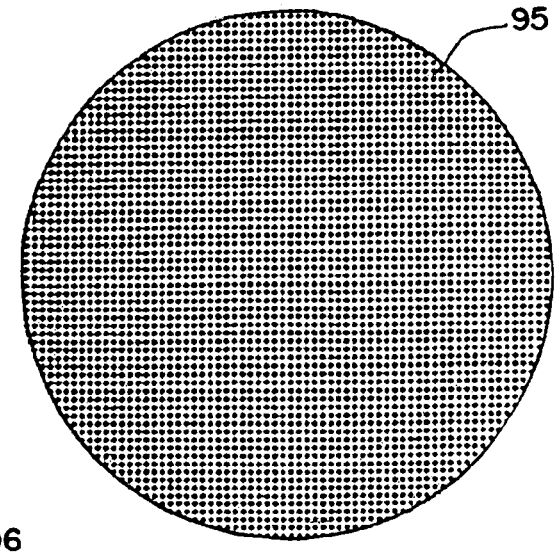
FIG. 17 is a dot matrix pattern that may be employed in the reflector of the clocks illustrated in FIGS. 1–4, 6 and 11.
Figure 18:
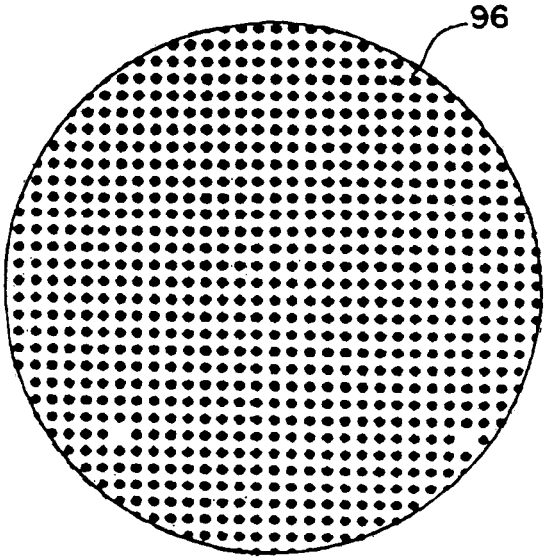
FIG. 18 is an alternative dot matrix pattern that may be used in the reflector of the clocks illustrated in FIGS. 1–4, 6 and 11.

The back side of reflectors 40, 60, 80 or 90 could alternatively be engraved to provide multiple raised surfaces, such as points, bumps, protuberances, or the like. FIGS. 17 and 18 illustrate surfaces, 95 and 96, respectively, created by dot engraving techniques. Such rough surfaces result in increased dispersion of light from the dial 35 of the clocks 20, 50 and 70 to provide more efficient night light capability. Use of engraving techniques can also provide more interesting backgrounds as seen through the dial 35 of the clocks 20, 50 and 70, including textures, decorative designs, decorative patterns, or the like. If a plastic sheet material or a metal foil is used on the back side of reflectors 40, 60, 80 or 90, as described above, such sheet materials or foils may also be embossed with textures, designs or patterns. Silk screen techniques may also be employed to imprint patterns, textures or designs on the back sides of reflectors 38, 48 or 78, or upon any sheet materials or foils disposed on or against the back sides of the reflectors.

Illumination modules, such as reflectors 38, 48 and 78, also have utility in providing lighting in other applications. For example, these illumination modules may also be used to provide illumination of street numbers for homes, businesses and apartments. Similarly, these illumination modules can provide illumination for mailboxes, light posts and the like. They can also provide background illumination for advertisements, signs, information panels and the like. For example, signs that are typically illuminated include emergency, exit and entrance signs in public buildings.

It will be understood that the embodiments of the present invention that have been described are illustrative of some of the applications of the principles of the present invention. Various changes and modifications may be made by those skilled in the art without departing from the true spirit and scope of the invention.

The invention claimed is:

1. An alarm clock of the analog type with hands to indicate the hour and minute; said alarm clock comprising:

a housing;

a dial disposed in the housing, said dial containing indicia for the hours, said dial being generally transparent;

an illumination module with generally planar front and rear surfaces, said illumination module of generally ovate shape with an enlarged end, said illumination module disposed in the housing with the front surface of said illumination module disposed behind and adjacently to the dial, said illumination module having a recess defined in the edge of the illumination module at the enlarged end; and a light source comprising one or more light emitting diodes disposed in said recess to provide illumination into said illumination module;

said edge of the illumination module having light reflective properties, except in the recess, to reflect light about the interior of said illumination module and out the front surface of the illumination module and through said dial to provide illumination exterior to said clock.

2. The alarm clock in accordance with claim 1 wherein said rear surface of the illumination module has light reflecting properties.

3. The alarm clock in accordance with claim 1 wherein said rear surface of the illumination module has an engraved surface to improve light dispersion within and out of the front surface of said illumination module.

4. The alarm clock in accordance with claim 1 wherein a light reflective material is disposed adjacently to the rear surface of the illumination module to reflect light within and out of the front surface of said illumination module.

5. The alarm clock in accordance with claim 1 wherein said illumination module is formed of a clear plastic material.

6. The alarm clock in accordance with claim 1 further comprising a light sensor to sense the ambient lighting conditions, to activate the light source when the ambient lighting conditions are below a predetermined threshold, and to deactivate the light source when the ambient lighting conditions are above the predetermined threshold.

7. The alarm clock in accordance with claim 1 further comprising a dimmer control to control the amount of illumination provided by the light source to the illumination module.

8. The alarm clock in accordance with claim 1 wherein said rear surface of the illumination module has an engraved surface to improve light dispersion within and out of said illumination module.

9. The alarm clock in accordance with claim 1 further comprising:

a second recess defined in the edge of said illumination module; and a second light source disposed in the second recess.

10. The alarm clock in accordance with claim 9 wherein said second light source is of a different color than said light source.

11. The alarm clock in accordance with claim 10 further comprising:

a battery to supply electrical power to said light source and to said second light source;

wherein said second light source is a red color and is activated when the battery needs replacement.

12. The alarm clock in accordance with claim 1 further comprising:

a manually operable alarm switch to enable an alarm.

13. The alarm clock in accordance with claim 12 wherein said manually operable alarm switch has an alarm off position, an illumination on position that enables the light source, and an alarm on and an illumination on position that enables both the alarm and the light source.

* * * * *